United States Patent [19]

Radek

[11] 4,124,144

[45] Nov. 7, 1978

[54] BEVERAGE STRAW DISPENSER

[75] Inventor: John R. Radek, Hinsdale, Ill.

[73] Assignee: Ready Metal Manufacturing Company, Chicago, Ill.

[21] Appl. No.: 790,473

[22] Filed: Apr. 25, 1977

[51] Int. Cl.[2] ..... A47G 19/30; B65H 3/06

[52] U.S. Cl. ..... 221/191; 221/277; 221/281

[58] Field of Search ..... 221/191, 192, 193, 254, 221/255, 256, 277, 281

[56] References Cited

U.S. PATENT DOCUMENTS

| | | | |
|---|---|---|---|
| 1,088,912 | 3/1914 | Long | 221/256 |
| 1,206,012 | 11/1916 | Manaresi | 221/277 |
| 2,828,048 | 3/1958 | Swanson | 221/277 |

*Primary Examiner*—Robert B. Reeves
*Assistant Examiner*—Francis J. Bartuska
*Attorney, Agent, or Firm*—Frank H. Marks

[57] ABSTRACT

A dispensing container for beverage straws and the like, intended for disposition on a restaurant table or counter, comprises a base portion on which rests a cylindrical housing having a concave, preferably frustoconical, floor and a vertically elongated side aperture for egress of straws. A dome-like closure rests over the housing with a hinged door for feeding straws into the housing. An axial rod extends from the dome through the housing and carries one or more radial, resilient vanes or pushers for feeding straws toward the egress aperture. The rod is keyed at its lower extremity to a rotary element having radial lugs extending through the base portion and exposed for digital engagement, whereby rotation of the rotary element turns the pushers, the latter acting on the straws to feed them toward the aperture. Consequently, a single straw at a time is tipped outwardly from the container for convenient grasping by the user. Straws usually employed in my dispenser are of resilient material such as plastic and paper wrapped for sanitation. The straws as well as the pusher vanes may temporarily be bent in the course of their normal movement, but will promptly resume their normal shape due to their resilience and no permanent distortion or damage will occur.

6 Claims, 9 Drawing Figures

BEVERAGE STRAW DISPENSER

My invention relates to beverage straw dispensing containers and has to do more particularly with articles of this type intended for disposition on a counter or table of a restaurant serving a large volume of trade. While not so restricted, my invention contemplates handling straws formed of resilient plastic wrapped individually in paper for sanitation purposes.

BACKGROUND

Beverage straws are usually dispensed from open containers wherein they are freely accessible. Thus, they are constantly exposed to contamination from dust and handling and possible vanadalism.

BRIEF OUTLINE OF INVENTION

A prime object of my invention is to provide a novel dispensing container for beverage straws which will restrict access thereto, normally presenting a single straw upon digital manipulation without damage to straws wholly within or exiting from the container while maintaining freedom from contamination and handling within the container. My invention is especially designed to handle wrapped straws of a resilient character.

A further object is to provide such a device that will be simple and inexpensive in construction, readily assembled from a minimum of parts, attractive in appearance, rugged and generally satisfactory for the purposes desired.

BRIEF DESCRIPTION OF DRAWINGS

Referring now to the drawings forming part of this specification and illustrating a preferred embodiment of my invention.

Figure 8:
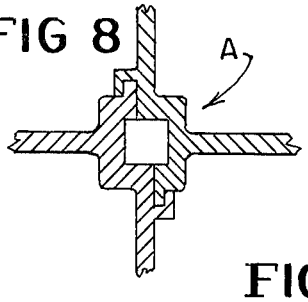
FIG. 8 is a transverse section of the vane unit to show its two-piece construction.
Figure 9:
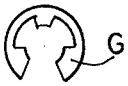
FIG. 9 is a plan view of a ring used in assembling the vane unit.
Figure 5:
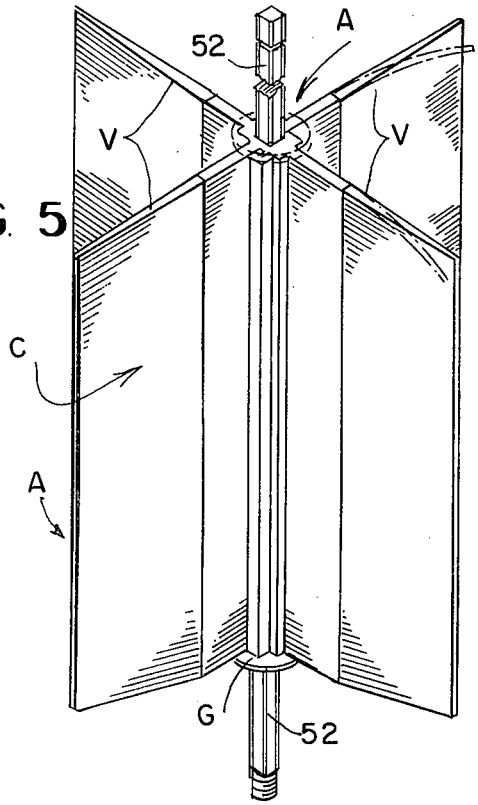
FIG. 5 is a perspective of a vane unit for advancing straws for exiting from the container.
Figure 1:
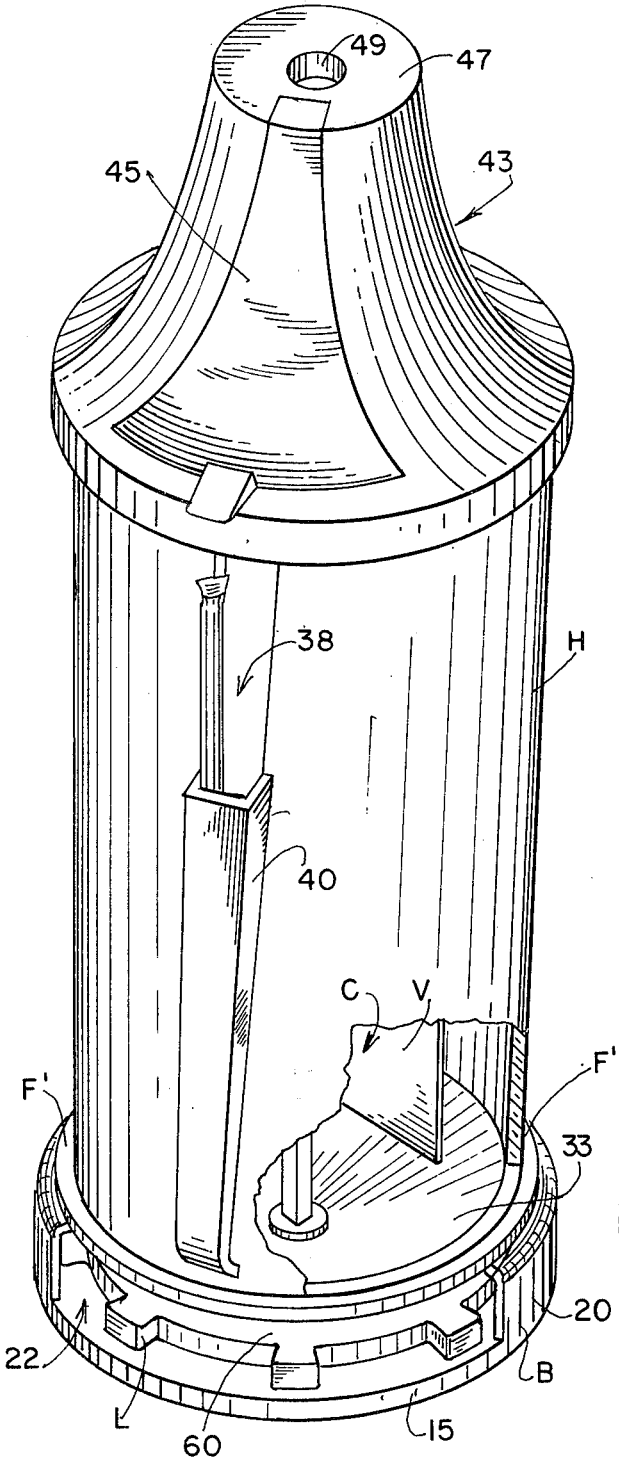
FIG. 1 is a perspective view of a straw dispenser constituting an embodiment of my invention.
Figure 6:
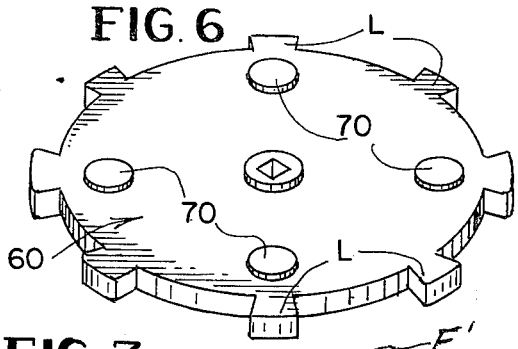
FIG. 6 is a perspective of a cog-wheel for manipulating the dispensing means.
Figure 7:
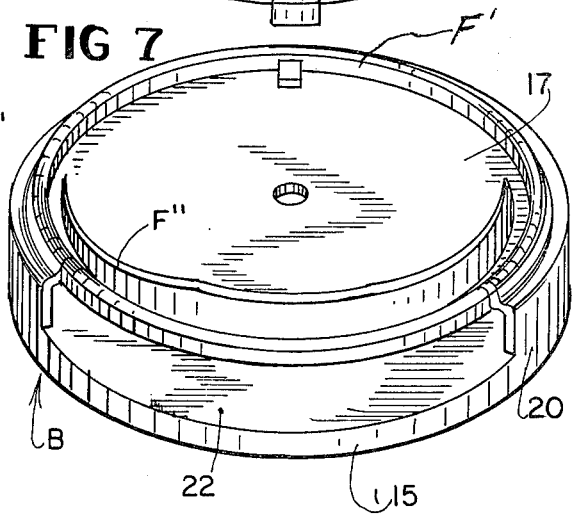
FIG. 7 is a perspective of a base portion.
Figure 3:
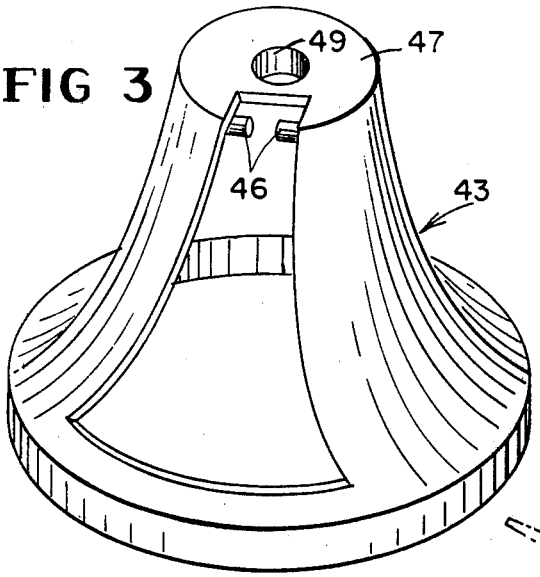
FIG. 3 is a perspective of a dome or lid portion.
Figure 4:
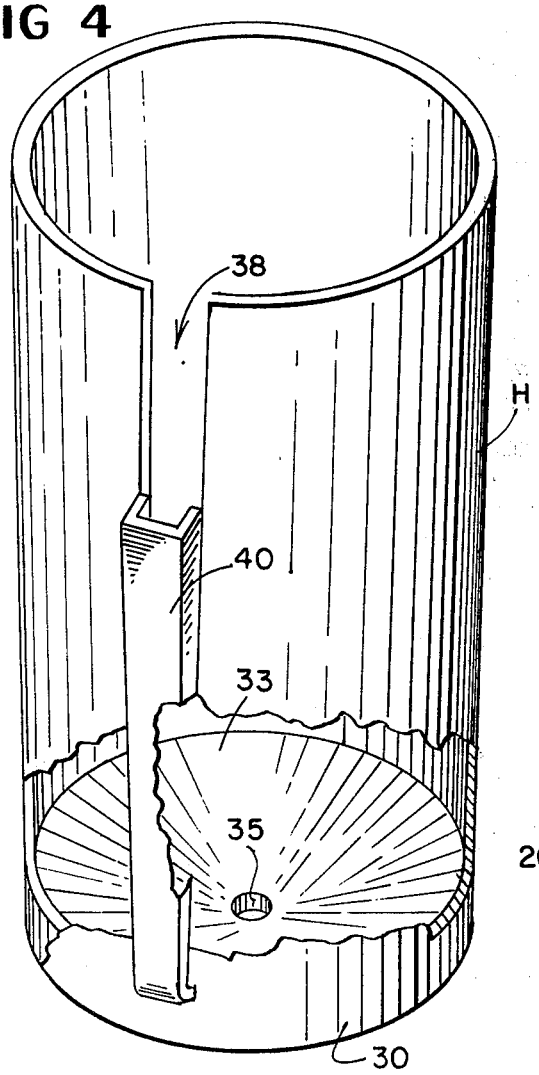
FIG. 4 is a perspective of a substantially cylindrical housing portion.
Figure 2:
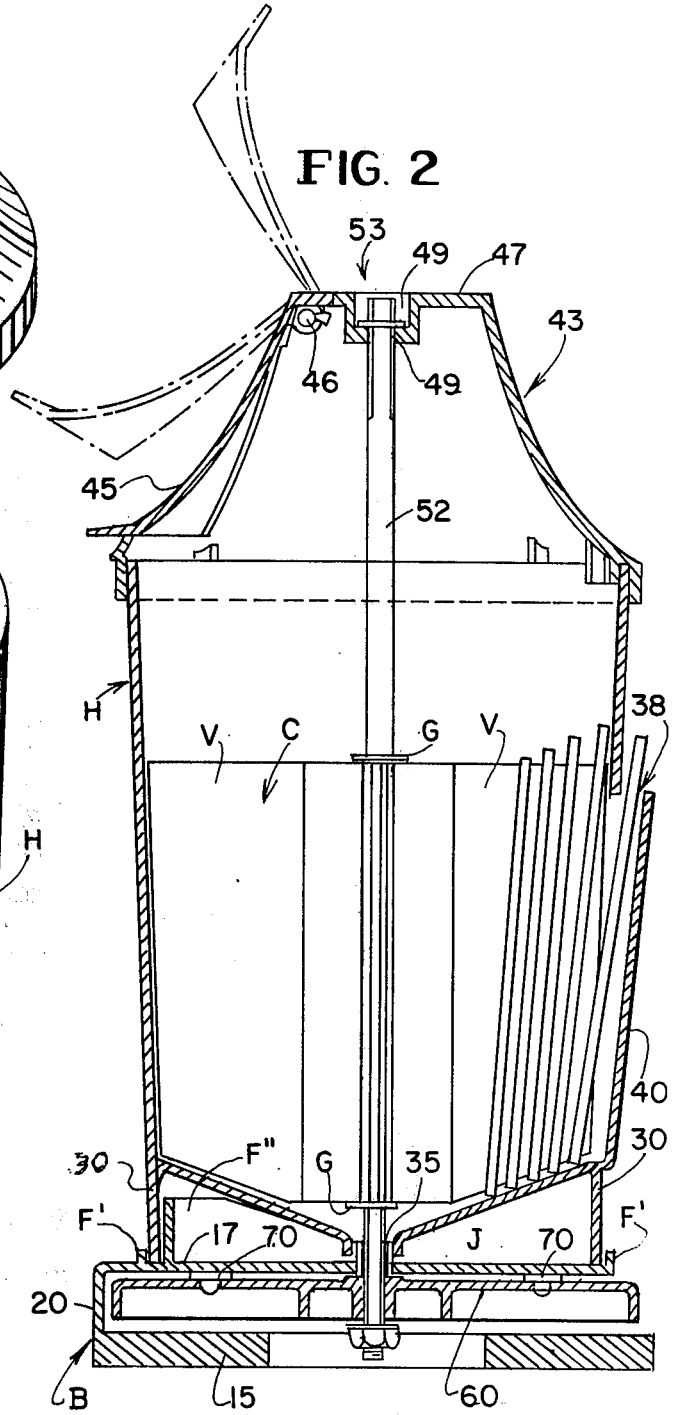
FIG. 2 is a vertical sectional view of same.

Reference character B indicates a base element which may conveniently be cast or die cast of suitable metal and chrome plated for attractive dress. It will be understood that materials mentioned are merely by way of example and not intended to be restrictive.

The base B is generally disk shaped with a circular bottom plate portion 15, an upper circular plate portion 17 with a space therebetween bounded by an annular wall portion 20 connecting plates 15 and 17. Wall 20 has an elongated aperture 22 therein of any desired length of its periphery, or long enough to serve a purpose that hereinafter appears.

The upper portion of base B is provided with a pair of concentric upstanding circular flanges F′ and F″, the latter being less than a complete circle, for the purpose of seating therebetween a cylindrical housing member H. Said housing may conveniently be molded of a substantially suitable transparent hard plastic such as, for example, that known in commerce as plexiglass. It will be understood that transparency, while desirable, is not essential. Housing H is provided with an integral depending annular flange 30 normally seating between upstanding flanges F′ and F″ of the base member. Also integral with the housing is a bottom wall portion 33 which is dished or concave, preferably frustoconical, for purposes that will appear, with a central opening 35.

Housing H has a vertically elongated window 38 for egress of straws. To inhibit escape of straws from said window the lower part thereof is protected by an outwardly extending generally U-shaped protective cover 40 which may be molded integrally with the housing. Channel 40 and window 38 may taper in width, gradually narrowing from top to bottom; the channel also slopes inwardly and downwardly.

A dome-like lid 43 is seated on housing H, said lid being generally frustoconical and provided with a door 45 hinged to the lid by suitable means such as pintles and journals on the respective parts. Said lid is liftable on its hinge for loading straws into the container.

Top wall 47 of lid 43 is cupped and apertured as at 49 to receive a rod 52 secured as by nut and/or Truarc retaining ring. The rod is preferably non-circular (say square) in cross-section to seat within a similarly shaped axial passage of a vane unit A designed for feeding straws toward exit opening 38. The vane unit is preferably, for convenient molding practice, molded in two interlocking generally similar parts of a suitable plastic such as a rigid vinyl composition having one or more (preferably 4) radial arms to which are secured vanes or pusher members V of resilient material, say, an elastomeric vinyl, said vanes defining compartments C therebetween of segmental cross-section. Said vanes may conveniently be of about the length of a straw intended for use in the dispenser.

The axial rod extends through passage 35 in bottom wall 33 of the cylindrical housing and is keyed to a wheel-like member 60 rotatably disposed in base B and retained as by a nut or the like below the wheel. Wheel 60 is provided with a plurality of radial lugs L that extend through opening 22 of base B and serve as digital manipulating members for rotating the vane unit.

In assembling, the square-section shaft is inserted in the square axial passage of the two-part vane unit and secured at top and bottom of the latter by suitable means such as Truarc retaining rings. Wheel 60, to which suitable bearing members 70 have been attached, is then inserted into the cavity provided therefor in base B. The dome member is then slipped over the vane assembly and shaft and the latter secured at top of dome by suitable means such as nut and/or Truarc retainer ring. The dome assembly is then slipped into the cylindrical housing H and the shaft located through the square hole in wheel 60, finally securing the shaft below the wheel as by a nut or the like.

In operation, to obtain a straw, one digitally engages a lug L and rotates wheel 60 in either direction. Vanes V of the vane unit are thus rotated by the wheel, moving the straws (wrapped in paper or unwrapped) upwardly and outwardly on sloping bottom surface 33 of the housing. As a straw is presented at window 38 its upper end will automatically tip out of the housing through the upper part of the window, assuming a slanting position within channel 40 which retains it against escape from the container. The upper part of the straw is thus exposed for convenient grasping by the user and extraction from the dispenser.

Should a vane or straw be bent in the course of the procedure, further rotation of the vane unit will result in such members springing back due to their inherent resilience and jamming will not occur nor will straws be damaged.

To load the container, door 45 is lifted and straws inserted through the dome, the vanes being rotated manually by the wheel to present chambers C successively until filling is complete.

CONCLUSION

It will be seen that I have developed an exceptionally convenient unit for the purposes mentioned, with a minimum of simple, inexpensive parts.

Various changes coming within the spirit of my invention will doubtless suggest themselves to those skilled in the art. Hence, I do not wish to be limited to the particular form shown or uses mentioned except to the extent indicated in the appended claims.

Without limitation, I preferably form all parts except the shaft and housing H of chrome plated plastic.

I claim:

1. A beverage straw dispenser comprising, (a) a unitary substantially cylindrical straw container having a protective cover on the top thereof and a shallow base for supporting the bottom of said container, said base having an arcuate peripheral slot, said container, said cover and said base arranged concentrically with an axial rod extending through the centers thereof for retaining said container, said cover and said base in assembled condition, (b) said straw container having a vertical gap in its lateral wall for the egress of a straw when moved adjacent thereto, (c) said cover having a straw loading opening to permit the charging of straws into said container in upstanding position, and a movable lid for said opening, (d) a plurality of radial vanes in said container mounted on said axial rod to advance the upstanding straws towards said gap, and provided with flexible outer portions to permit yieldability of the vanes in the course of their rotary movement within said container, and (e) a rotary actuating disk connected to said axial rod and housed within said shallow base, said disk provided with radial members on the outer periphery thereof protruding through said arcuate slot in said base, said members adapted for digital movement to rotate said vanes, thereby to push the straws in the container toward said gap.

2. A device as set forth in claim 1, wherein said container is provided with a concave floor.

3. A device set forth in claim 1, including a vertical channel member on the outside of said container across the lower portion of said gap for limiting the outward movement of a straw which has passed through said gap.

4. A beverage straw dispenser comprising, (a) a unitary substantially cylindrical straw container having a concave floor and a vertically elongated side window for straw egress, (b) a cover for said container having a central perforation and a straw loading aperture therein, (c) a shallow base member and a rotary actuator disk housed therein having radial peripheral projections, both said member and said disk having a small central opening therein in alignment with said perforation in said cover, (d) a vertical rod extending through said container between said cover and base and through said perforation and central openings, with fastening means at the opposite ends thereof for maintaining the parts in assembled condition, (e) said hollow base member having an arcuate opening in its periphery providing digital access to said projections on said disk, and (f) radial vanes on said axial rod at the lower portion of said container provided with flexible outer portions for pushing the straws in said container toward said window for egress therethrough.

5. A device as set forth in claim 4, including a channel member on the outside of said container overlying said window for limiting the outward movement of the individual straws when they pass through the window until they are withdrawn manually.

6. A device as set forth in claim 4, wherein said shallow base member is provided with an annular seat on the top surface thereof for seating the lower end of said container.

* * * * *